United States Patent [19]

Kohka

[11] Patent Number: 4,608,474

[45] Date of Patent: Aug. 26, 1986

[54] NEGATIVE THERMAL EXPANSION METAL ELECTRICALLY CONNECTED TO MOTOR MEANS FOR MICROWAVE OVEN

[75] Inventor: Kenichi Kohka, Amagasaki, Japan

[73] Assignee: Sharp Kabushiki Kaisha, Osaka, Japan

[21] Appl. No.: 519,700

[22] Filed: Aug. 2, 1983

[30] Foreign Application Priority Data

Aug. 4, 1982 [JP] Japan ..... 57-119023[U]

[51] Int. Cl.[4] ..... H05B 6/64

[52] U.S. Cl. ..... 219/10.55 R; 219/10.55 B; 237/46

[58] Field of Search ..... 219/10.55 E, 10.55 F, 219/10.55 B, 10.55 R, 10.55 A; 236/68 R, 93 R; 237/46, 47, 48

[56] References Cited

U.S. PATENT DOCUMENTS 4,284,235 8/1981 Diermayer et al. ..... 236/68 R X 4,369,347 1/1983 Shin ..... 219/10.55 B

*Primary Examiner*—Clarence L. Albritton

*Assistant Examiner*—Marvin M. Lateef

*Attorney, Agent, or Firm*—Birch, Stewart, Kolasch & Birch

[57] ABSTRACT

A high frequency heating apparatus including a motor having a first and second windings, the apparatus comprising damper means for controlling the intake of air into a heating chamber and negative thermal expansion metal for moving the damper means in response to the changes in the shape of the negative thermal expansion metal means, the negative thermal expansion metal means being electrically coupled to the second winding of the motor.

6 Claims, 7 Drawing Figures

NEGATIVE THERMAL EXPANSION METAL ELECTRICALLY CONNECTED TO MOTOR MEANS FOR MICROWAVE OVEN

BACKGROUND OF THE INVENTION

The present invention relates to a high frequency heating apparatus, more particularly, to a high frequency heating apparatus provided with a damper which is opened or closed by using a negative thermal expansion metal such as a shape memory alloy.

Recently, a high frequency heating apparatus has been generally used which functions as both a microwave heating oven and a convection heating oven for recirculating heated air in a heating chamber to cook the foodstuff.

In such a high frequency heating apparatus, gas associated with steam or smells or produced from heated foodstuff in the heating chamber is ventilated from the heating chamber to the outside by air cooling electrical components such as a magnetron or the like in the mode of the microwave heating oven. In the mode of the convection heating oven, the air which is introduced into the heating chamber must be sealed to effectively raise the temperature in the heating chamber, by closing a damper.

The conventional damper is opened and closed by an operating lever provided on an operating panel, or automatically by a solenoid or the like.

Further, recently, a damper mechanism which is operated by using a spring made of a shape memory alloy has been proposed as disclosed in U.S. patent application Ser. No. 484,460, filed on Apr. 13, 1983 by M. TANIGAWA, entitled "MICROWAVE OVEN DAMPER MECHANISM ACTIVATED BY A SHAPE MEMORY ALLOY". The U.K. Pat. counterpart was filed on Apr. 12, 1983 as No. 8309895. The German Pat. counterpart was filed on Apr. 19, 1983 as No. P3314055.3. Usually, it is necessary to supply a power such as low voltage and a high current in the shape memory alloy in order to change its shape. Accordingly, a transformer for reducing the voltage must be provided for driving the shape memory alloy, and a power circuit is additionally required for precluding the feeding of current to the shape memory alloy in order to continuously open the damper in the microwave heating mode, or for feeding the current directly to the shape memory alloy in order to continuously close the damper in the convection heating mode. Since the transformer and the power circuit need many components, a circuit for the apparatus is not simple.

SUMMARY OF THE INVENTION

An object of the present invention is to simplify a power source for applying current to a negative thermal expansion metal such as a shape memory alloy which opens and closes a damper of a high frequency heating apparatus.

Another object of the present invention is to provide a secondary winding coupled to a winding of a motor provided in the high frequency heating apparatus, the secondary winding supplying electric power to a spring made of a negative thermal expansion metal such as a shape memory alloy which operates a damper.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to the present invention, a high frequency heating apparatus including a motor having a first and second windings, the apparatus comprising damper means for controlling the intake of air into a heating chamber and negative thermal expansion metal means for moving the damper means in response to the changes in the shape of the negative thermal expansion metal means, the negative thermal expansion means being electrically coupled to the second winding of the motor.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 3(*b*) is a schematic sectional view in a microwave heating mode of the embodiment of a high frequency heating apparatus of the present invention;

DETAILED DESCRIPTION OF THE INVENTION

General characteristics of a shape memory alloy (element) used for a preferred embodiment of the present invention are detailed below.

Figure 1:
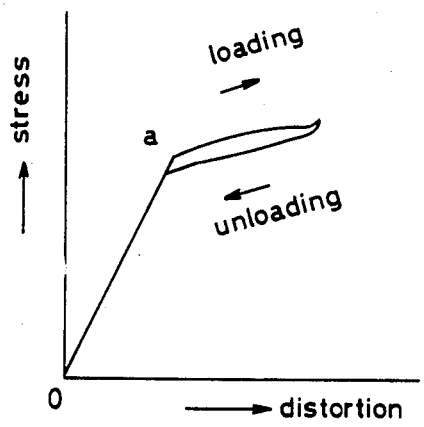
FIG. 1 shows the "stress to distortion" characteristics while the shape memory alloy used for the present invention still remains in a high temperature phase (austenite phase)

FIG. 1 shows the "stress to distortion" characteristics while a high temperature phase (austenite phase) still remains, where a super-elastic characteristic of the shape memory alloy in returning to the original shape is represented after it is freed from any distortion with its load being discharged, even though it may be subject to deformation beyond the apparent yield point "a".

Figure 2:
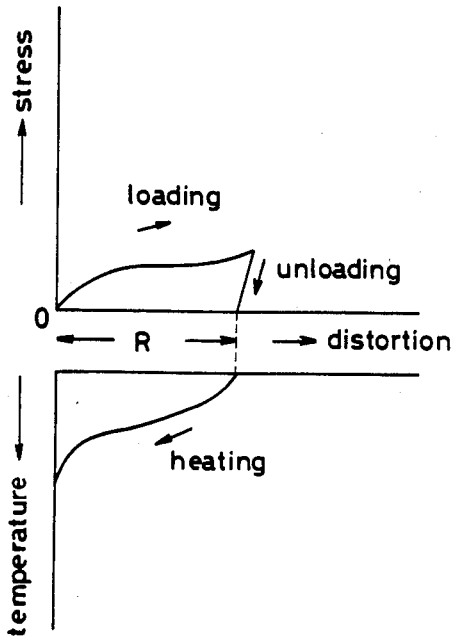
FIG. 2 shows the other "stress to distortion" characteristics while the shape memory alloy used for the present invention still remains in a low temperature phase (martensite phase)

FIG. 2 shows the other "stress to distortion" characteristics while a low temperature phase (martensite phase) still remains, where, even though a permanent distortion "R" will remain after the shape memory alloy is deformed beyond the apparent yield point "a", the shape memorizing characteristic of the shape memory alloy in returning to the initially memorized original shape by the heating effect is clearly represented. Typically, alloys comprising Ti-Ni, Cu-Al-Ni, and Cu-Al-Zn, are made available for composing a shape memory alloy (element) which should exhibit such advantagous characteristics as described above.

Figure 3:
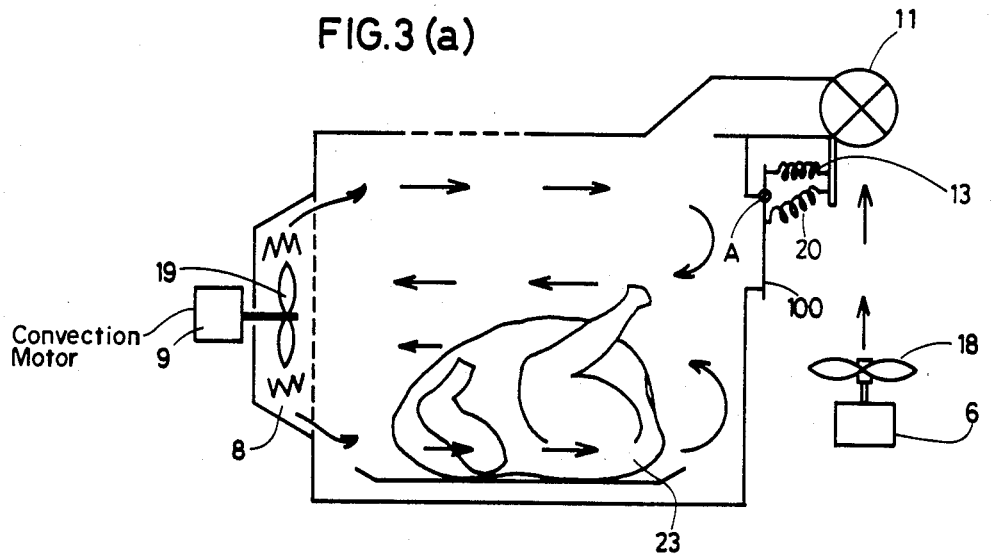
FIG. 3(*a*) is a schematic sectional view in a convection mode of an embodiment of a high frequency heating apparatus of the present invention.
Figure 3B:
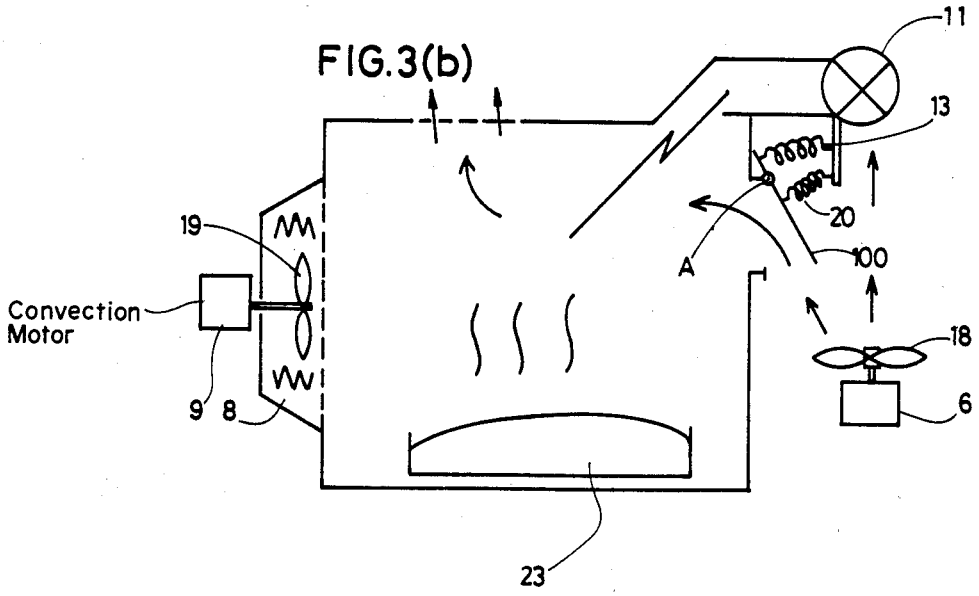

FIG. 3(*a*) is a schematic sectional view in a convection mode of an embodiment of a high frequency heating apparatus of the present invention. FIG. 3(*b*) is a schematic sectional view in a microwave heating mode of the embodiment of a high frequency heating apparatus of the present invention. A high frequency heating apparatus of the present invention functions as at least both the microwave heating oven and the convection heating oven. In FIGS. 3(*a*) and 3(*b*), there is a convection motor 9 for rotating a convection fan 19, a convection heater 8 for serving as a convection heating source, a magnetron 11 for generating microwave energy, a cooling blower motor 6 for rotating a cooling fan 18, a spring type elastic body 13 made of a shape memory alloy for closing a damper 100 in order to interrupt the air from the cooling fan 18 into a heating chamber 1, a bias spring 20 for opening the damper 100 in order to introduce the air from the cooling fan 18 into the heating chamber 1, and foodstuff 23 which is heated in the convection heating mode or in the microwave heating mode.

According to the present invention, the damper 100 pivots on a point A with the stresses of the elastic body 13 and the bias spring 20.

Figure 4:
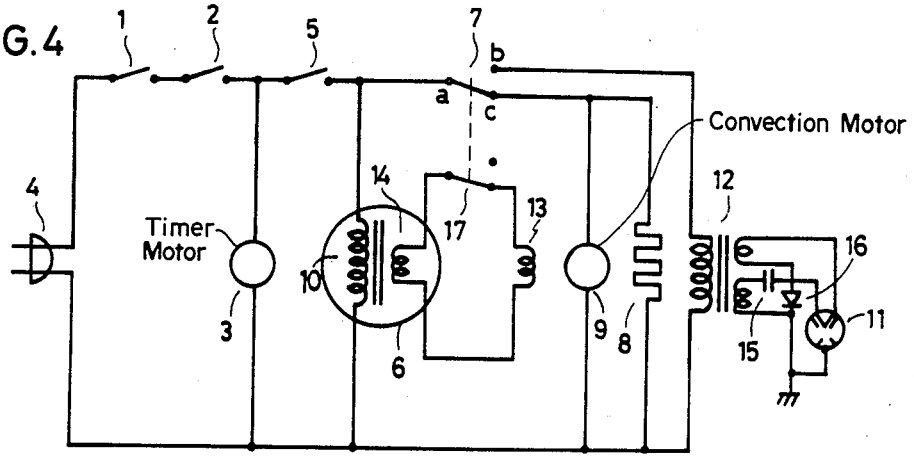
FIG. 4 is a circuit diagram used for the embodiment of the high frequency heating apparatus of the present invention.

FIG. 4 is a circuit diagram used for the embodiment of the high frequency heating apparatus of the present invention. A time motor 3 is connected to a commercial power source 4 in series via a door switch 1 and a cooking start switch 2. The cooling blower motor 6 is connected to the commercial power source 4 in series via a timer switch 5 of the timer motor 3. The cooling blower motor 6 is driven to rotate the cooling fan 18 which cools electrical components such as the magnetron 11 or the like. A cooking select switch 7 is switched between a microwave cooking mode and a convection cooking mode. The cooking select switch 7 comprises a moving contact a, and fixed contacts b and c. The moving contact a of the cooking select switch 7 is connected to one end of the cooling blower motor 6. The fixed contact c of the cooking select switch 7 is connected to the convection motor 9 and the convection heater 8 for serving as a convection heating source. When the moving contact a is connected to the fixed contact c, the convection heating mode is selected. The other fixed contact b is connected to a high voltage transformer 12 for driving the magnetron 11 for the microwave heating mode via a high voltage condenser 15 and a high voltage diode 16. When the moving contact a is connected to the fixed contact b, the microwave heating mode is selected.

The spring type elastic body 13 made of a shape memory alloy is connected to a secondary winding 14 provided at the secondary position of a winding 10 of the cooling blower motor 6 via a switch 17. One end of the eleastic body 13 made of the shape memory alloy is connected to the damper 100 which shuts out the air entering into the heating chamber 1 as shown in FIG. 3(*a*). The switch 17 is switched on in connection with the operation of the cooking select switch 7.

Figure 5:
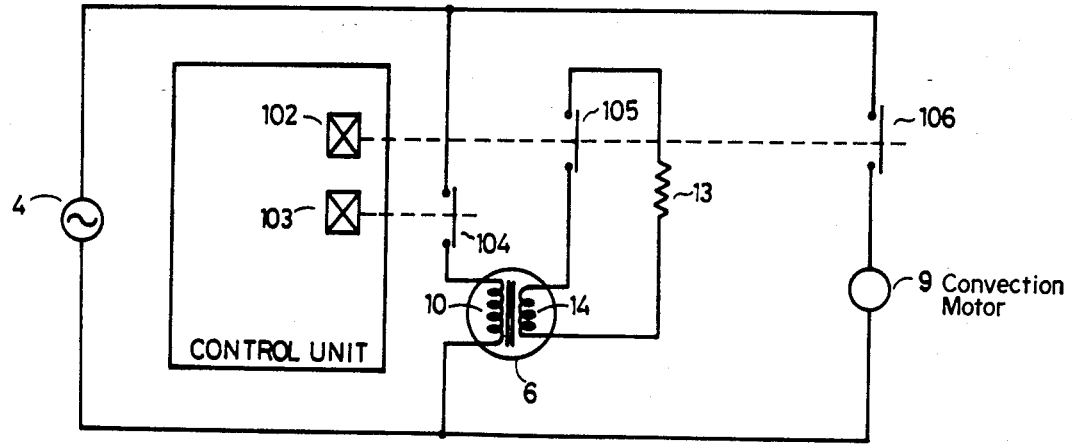
FIG. 5 is a more detailed circuit diagram of the curcuit of FIG. 4.

FIG. 5 is a more detailed circuit diagram of the circuit of FIG. 4. When the convection heating mode is selected by the cooking select switch 7, a convection motor relay 102 and a cooling blower motor relay 103 are operated, so that switches 104, 105 and 106 are switched on. Accordingly, the convection motor 9 and the cooling blower motor 6 are driven, and the elastic body 13 made of the shape memory alloy receives electric power from the secondary winding 14 provided at the secondary position of the winding 10 of the cooling blower motor 6. When the temperature of the elastic body 13 is high, the elastic body 13 is returned to the memorized shape to thereby shrink. When the shrink power of the elastic body 13 is greater than the stress by the bias spring 20, the damper 100 pivots on a point A, so that the damper 100 is continuously closed. The introduction of the air from the cooling fan 18 to the heating chamber 1 is interrupted by the damper 100, and the air in the chamber 1 is heated to cook the foodstuff 23. The heated air is circulated in the chamber 1 by the convection fan 19.

When the microwave heating mode is selected by the cooking select switch 7, the convection motor relay 102 is not operated, so that the switches 105 and 106 are switched off. Because only the cooling blower motor relay 103 is operated, the switch 104 is switched on, so that the cooling blower motor 6 is driven. The air from the cooling fan 18 is introduced into the heating chamber 1, and the magnetron 11 generates the microwave energy for cooking the foodstuff 23.

Figure 6:
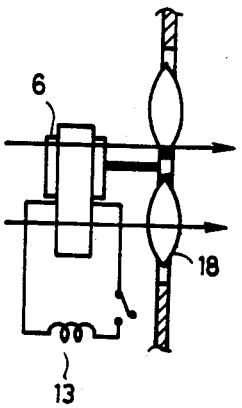
FIG. 6 is a sectional view of a cooling blower motor 6 and a cooling fan 18.

FIG. 6 is a sectional view of the cooling blower motor 6 and the cooling fan 18.

The operation of the high frequency heating apparatus of the embodiment of the present invention will be described as follow.

(CONVECTION HEATING MODE)

In FIG. 3(*a*), When the moving contact a of the cooking select switch 7 is connected to the fixed contact c of the cooking select switch 7 after the door switch 1, the cooking start switch 2 and the timer switch 5 are switched on, the commercial power source 4 applies the current to the convection heater 8 and the convection motor 9. The temperature of the air in the heating chamber is raised by the convection heater 8, and heated air is circulated by the convection fan 19 which is driven by the convection motor 9. The foodstuff 23 is heated to cook by heated air. As mentioned above, the convection heating mode for cooking is executed.

When the door switch 1, the cooling switch 2 and the timer switch 5 are switched on, the cooling blower motor 6 is driven to rotate the cooling fan 18, so that the electrical components such as the magnetron 11 or the like cool. In this time, if the moving contact a of the cooking select switch 7 is connected to the fixed contact c, the switch 17 is switched on in connection with the operation of the cooking select switch 7, and an AC voltage produced with the ratio between the number of the winding 10 of the cooling blower motor 6 and the number of the secondary winding 14 is applied to the elastic body 13 made of the shape memory alloy, and the temperature of the elastic body 13 is raised. With this raise in temperature, the elastic body 13 made of the shape memory alloy causes a shrink power for returning to the memorized shape in order to close the damper 100 and interrupt the air which is inputted into the heating chamber 1. When the shrink power of the elastic body 13 is greater than the stress by the bias spring 20, the damper 100 pivots on a point A, so that the damper 100 is continuously closed. In this way, the damper 100 is coutinuously closed in the convection heating mode, so that the temperature of the heating chamber is raised effectively, and the foodstuff 23 is heated to cook.

(MICROWAVE HEATING MODE)

In FIG. 3(*b*), when the moving contact a is connected to the fixed contact b after the door switch 1, the cooking select switch 2 and the timer switch 5 are switched on, the magnetron 11 connected to the secondary winding of the high voltage transfomer 12 generates a microwave energy. The microwave energy generated by the magnetron 11 is applied to cook the foodstuff 23 in the heating chamber 1 via a wave guide 101. In this way, the microwave heating mode is executed. When the moving contact a is connected to the fixed contact b, the switch 17 is switched off, and the current is not applied on the elastic body 13, so that the temperature of the elastic body 13 made of the shape memory alloy is not raised. Therefore, the elastic body 13 has no shrink power for returning to the memorized shape, so that the damper 100 is opened by the bias spring 20 in the preselected position.

Accordingly, after cooling air applied by the cooling blower motor 6 cools the electrical components such as the magnetron 11 or the like, the cooling air is entered into the heating chamber 1, and gas such as steam or smell produced from the heated foodstuff is exhausted from the heating chamber to the outside by force.

According to an embodiment of the invention, the winding 10 of the cooling blower motor 6 is cooled by the cooling fan 18, so that the temperature of the winding 10 can be low.

The secondary winding applying the power to the elastic body 13 made of the shape memory alloy may be provided not only in the cooling blower motor but also in any other motor of the high frequency heating apparatus.

The shape memory alloy can be replaced by a metal having a negative thermal expansion for shrinking in response to exposure to the heat.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A high frequency heating apparatus comprising:

damper means for opening and closing an air intake port of a heating chamber, said damper means including a member made of a material such that the shape of the member alters upon heating or cooling thereof so that control of opening and closing said damper means can be effected by selected delivery of an electric heating current to said damper means; an electric cooling blower motor including motor winding means for rotating a cooling fan which cools electrical components and said member;

means for deriving said electric heating current from current in said motor winding means; and means for selectively applying said electric heating current to said member of said damper means;

said cooling fan directing air on said member to accelerate the cooling thereof when no heating current is applied thereto.

2. The high frequency heating apparatus of claim 1 wherein said means for selectively applying comprises a mode selection switch having a moving contact connected to one end of a cooling blower motor and another end selectively engaged with either a fixed contact for a convection heating mode or a fixed contact for a microwave heating mode.

3. The high frequency heating apparatus of claim 1 wherein said member made of a material that alters upon heating or cooling thereof is a shape memory alloy.

4. The high frequency heating apparatus of claim 1, wherein said high frequency heating apparatus functions as at least both a convection heating oven and a microwave heating oven.

5. The high frequency heating apparatus of claim 3, wherein said member made of a shape memory alloy is a positive thermal expansion metal.

6. The high frequency heating apparatus of claim 3, wherein said member made of a shape memory alloy is a negative thermal expansion metal.

* * * * *